US009948046B1

(12) United States Patent
Peng

(10) Patent No.: US 9,948,046 B1
(45) Date of Patent: Apr. 17, 2018

(54) COMPOSITE CONNECTOR

(71) Applicant: LOTES CO., LTD, Keelung (TW)

(72) Inventor: Jian Min Peng, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/366,155

(22) Filed: Dec. 1, 2016

(30) Foreign Application Priority Data

Sep. 22, 2016 (CN) ..... 2016 2 1069704 U
Sep. 30, 2016 (CN) ..... 2016 2 1094520 U

(51) Int. Cl.
*H01R 33/00* (2006.01)
*H01R 27/02* (2006.01)
*H01R 24/62* (2011.01)
*H01R 29/00* (2006.01)
*H01R 107/00* (2006.01)

(52) U.S. Cl.
CPC ..... *H01R 27/02* (2013.01); *H01R 24/62* (2013.01); *H01R 29/00* (2013.01); *H01R 2107/00* (2013.01)

(58) Field of Classification Search
CPC ..... H01R 23/688; H01R 23/6873
USPC ..... 439/101, 108, 607.08–607.11, 607.35, 439/607.4
See application file for complete search history.

(56) References Cited

U.S. PATENT DOCUMENTS 6,540,559 B1 * 4/2003 Kemmick ..... H01R 23/688 439/108
8,070,529 B2 * 12/2011 Xiong ..... H01R 12/725 439/620.15
8,100,713 B2 * 1/2012 Luo ..... H01R 12/712 439/541.5
8,123,562 B2 * 2/2012 Zhou ..... H01R 9/032 439/607.48
8,177,564 B1 * 5/2012 Ito ..... H01R 13/6471 439/108
8,333,619 B2 * 12/2012 Kondo ..... H01R 13/6474 439/676
8,672,691 B2 * 3/2014 Kondo ..... H01R 13/6471 439/108
8,684,769 B2 * 4/2014 Kao ..... H01R 13/6471 439/607.28

(Continued)

FOREIGN PATENT DOCUMENTS

CN 101587993 B 9/2011
CN 202633554 U 12/2012

(Continued)

*Primary Examiner* — Thanh Tam Le
(74) *Attorney, Agent, or Firm* — Locke Lord LLP; Tim Tingkang Xia, Esq.

(57) ABSTRACT

A composite connector includes a first tongue, a second tongue, and multiple terminal units respectively arranged on the first tongue and the second tongue. Each of the terminal units includes four terminals independent from each other, which are respectively two non-high-speed differential signal terminals and a pair of high-speed differential signal terminals located between the two non-high-speed differential signal terminals. Terminals in each terminal unit are made of a same metal plate and are located on a same plane. There is no other terminal between adjacent two terminal units. A non-high-speed differential signal terminal of one terminal unit is adjacent to a non-high-speed differential signal terminal of an adjacent terminal unit.

14 Claims, 7 Drawing Sheets

(56) References Cited

U.S. PATENT DOCUMENTS

| | | | | |
|---|---|---|---|---|
| 9,022,800 | B2 * | 5/2015 | Yang | H01R 13/6581 439/487 |
| 9,281,626 | B2 * | 3/2016 | Lin | H01R 13/6581 |
| 9,281,643 | B1 * | 3/2016 | Tseng | H01R 13/518 |
| 9,300,095 | B2 * | 3/2016 | Lin | H01R 24/60 |
| 9,306,336 | B2 * | 4/2016 | Chang | H01R 13/6471 |
| 9,325,119 | B2 * | 4/2016 | Wu | H01R 13/6471 |
| 9,379,499 | B2 * | 6/2016 | Miyoshi | H01R 24/60 |
| 9,425,559 | B2 * | 8/2016 | Kao | H01R 13/6585 |
| 9,484,676 | B2 * | 11/2016 | Chuang | H01R 13/6581 |
| 9,502,821 | B2 * | 11/2016 | Little | H01R 13/6582 |
| 9,502,840 | B2 * | 11/2016 | Kao | H01R 13/6581 |
| 9,525,251 | B2 * | 12/2016 | Yen | H01R 24/60 |
| 2012/0115371 | A1 * | 5/2012 | Chuang | H01R 12/724 439/660 |
| 2016/0013599 | A1 | 1/2016 | Ueda et al. | |

FOREIGN PATENT DOCUMENTS

| | | | |
|---|---|---|---|
| CN | 103579861 | A | 2/2014 |
| CN | 204179317 | U | 2/2015 |
| CN | 102201628 | B | 3/2015 |
| CN | 104779489 | A | 7/2015 |
| CN | 204809560 | U | 11/2015 |
| CN | 205452594 | U | 8/2016 |
| CN | 104319576 | B | 9/2016 |
| TW | I420763 | B | 12/2013 |

* cited by examiner

COMPOSITE CONNECTOR

CROSS-REFERENCE TO RELATED APPLICATION

This non-provisional application claims priority to and benefit of, under 35 U.S.C. § 119(a), Patent Application No. 201621069704.5 filed in P.R. China on Sep. 22, 2016, the entire content of which is hereby incorporated by reference.

FIELD OF THE INVENTION

The present invention relates to an electrical connector, and more particularly to a composite connector that can satisfy extensions with different specifications.

BACKGROUND OF THE INVENTION

The Chinese patent application CN201420624612.3 discloses a composite connector, which includes a metal casing that forms two sockets. Two tongues are correspondingly located in the two sockets respectively. A row of terminals is provided on both upper and lower surfaces of each of the tongues. Each row of terminals consists of 12 terminals. The four terminals in the center are short. In two groups of terminals on two sides, the middle two terminals are short, and the two terminals on outer sides are long. The row of terminals is suitable for USB TYPE C signal transmission.

The above composite connector laterally integrates two standard USB TYPE C connectors with a same specification. In each row of terminals in the two sockets, because shapes of the 12 terminals are irregular, the 12 terminals need to be formed as one module by punching one plate using a mold. When extensions with different specifications need to be implemented or the number of extension terminals is large, the process is more difficult and the cost of the mold is high.

Therefore, a heretofore unaddressed need exists in the art to address the aforementioned deficiencies and inadequacies.

SUMMARY OF THE INVENTION

In one aspect, the present invention relates to a composite connector that is convenient for extending signals with different specifications, has simplified molds, and has low costs.

In certain embodiments, a composite connector includes an insulation body and multiple terminal units arranged on the insulation body. Each of the terminal units includes four terminals independent from each other, which are respectively two non-high-speed differential signal terminals and a pair of high-speed differential signal terminals located between the two non-high-speed differential signal terminals. Lengths of the non-high-speed differential signal terminals are greater than lengths of the high-speed differential signal terminals. There is no other terminal between adjacent two terminal units, and non-high-speed differential signal terminals of one terminal unit are provided adjacent to non-high-speed differential signal terminals of the other one terminal unit.

In certain embodiments, the multiple terminal units form an upper row of terminals and a lower row of terminals, and the upper row of terminals and the lower row of terminals are aligned with each other in an up-to-down direction. Each of the upper row of terminals and the lower row of terminals are respectively made by a same metal plate, and located on a same plane.

In certain embodiments, the non-high-speed differential signal terminals are ground terminals, power terminals, or low speed signal terminals. The high-speed differential signal terminal has a first contacting portion and a first connecting portion that extends from the first contacting portion. The first contacting portion is exposed on a surface of the insulation body. A width of the first connecting portion is less than a width of the first contacting portion. The non-high-speed differential signal terminal has a second contacting portion and a second connecting portion that extends from the second contacting portion. The second contacting portion is exposed on a surface of the insulation body. A width of the second connecting portion is greater than a width of the first connecting portion. A distance between the first contacting portion and the adjacent second contacting portion is equal to a distance between the first connecting portion and the adjacent second connecting portion. The high-speed differential signal terminal has a first head portion located in front of the first contacting portion, and a first tail portion located behind the first connecting portion. The non-high-speed differential signal terminal has a second head portion located in front of the second contacting portion, and a second tail portion located behind the second connecting portion. The second tail portion is flush to the first tail portion, and the second head portion exceeds the first head portion forward.

In certain embodiments, the composite connector further includes a metal shell, which is sleeved on the insulation body to form a first plug interface and a second plug interface. The first plug interface is used for insertion of a first mating connector. The second plug interface is used for insertion of a second mating connector. A combination of the first plug interface and the second plug interface is used for insertion of a third mating connector.

In another aspect, the present invention relates to a composite connector. In certain embodiments, the composite connector includes a first tongue and a second tongue, and multiple terminal units respectively arranged on the first tongue and the second tongue. Each of the terminal units includes four terminals independent from each other, which are respectively two non-high-speed differential signal terminals and a pair of high-speed differential signal terminals located between the two non-high-speed differential signal terminals. Terminals in the same terminal units are made of a same metal plate and are located on a same plane. There is no other terminal between adjacent two terminal units, and non-high-speed differential signal terminals of one terminal unit are provided adjacent to non-high-speed differential signal terminals of another terminal unit.

In certain embodiments, the non-high-speed differential signal terminals are ground terminals, power terminals, or low speed signal terminals. The high-speed differential signal terminal has a first contacting portion and a first connecting portion that extends from the first contacting portion. The first contacting portion is exposed on a surface of the first tongue/second tongue. A width of the first connecting portion is less than a width of the first contacting portion. The non-high-speed differential signal terminal has a second contacting portion and a second connecting portion that extends from the second contacting portion. The second contacting portion is exposed on a surface of the first tongue/second tongue. A width of the second connecting portion is greater than a width of the first connecting portion. A distance between the first contacting portion and the adjacent second contacting portion is equal to a distance between the first connecting portion and the adjacent second connecting portion.

In certain embodiments, lengths of the non-high-speed differential signal terminals are greater than lengths of the high-speed differential signal terminals.

In certain embodiments, multiple terminal units are provided on both upper and lower surfaces of the first tongue and the second tongue to respectively form an upper row of terminals and a lower row of terminals, and the number of the terminal units on the first tongue is not equal to the number of the terminal units on the second tongue. The multiple terminal units located on the upper surfaces of the first tongue and the second tongue are made of a same metal plate and are located on a same plane, and the multiple terminal units located on the lower surfaces of the first tongue and the second tongue are made of a same metal plate and are located on a same plane. A middle shielding sheet is respectively embedded in the first tongue and the second tongue. The middle shielding sheet is located between the upper row of terminals and the lower row of terminals, and the upper row of terminals and the lower row of terminals are symmetrically provided with the middle shielding sheet as an axis of symmetry.

In certain embodiments, a width of the first tongue is different from a width of the second tongue. There is a distance between the first tongue and the second plate, and the distance is a width needed by one or more terminal units. The first tongue and the second tongue are respectively formed by extending from a same base, and the first tongue and the second tongue are located on a same plane. Three of the terminal units are respectively provided on upper and lower surfaces of the first tongue, and terminal arrangement on the first tongue is suitable for USB TYPE C signal transmission.

In certain embodiments, the composite connector further includes a metal shell. The metal shell surrounds respectively the first tongue and the second tongue to form a first plug interface and a second plug interface. The first plug interface is used for insertion of a first mating connector, and the second plug interface is used for insertion of a second mating connector. A combination of the first plug interface and the second plug interface is used for insertion of a third mating connector.

Compared with the related art, according to certain embodiments of the present invention, a terminal unit is formed by using two non-high-speed differential signal terminals and a pair of high-speed differential signal terminals located between the two non-high-speed differential signal terminals. The terminal units are sequentially arranged on an insulation body. Because the high-speed differential signal terminals can be downwardly compatible with non-high-speed differential signal transmission, extensions of signals with different specifications can be implemented in the manner of sequentially arranging the terminal units. Moreover, a punching mold for shaping terminals can be simplified in the manner of successively arranging, in an electrical connector, units with each being formed by four terminals, so as to reduce mold costs, so that fabrication and production of molds become easier and a requirement for a large number of terminals can be satisfied.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
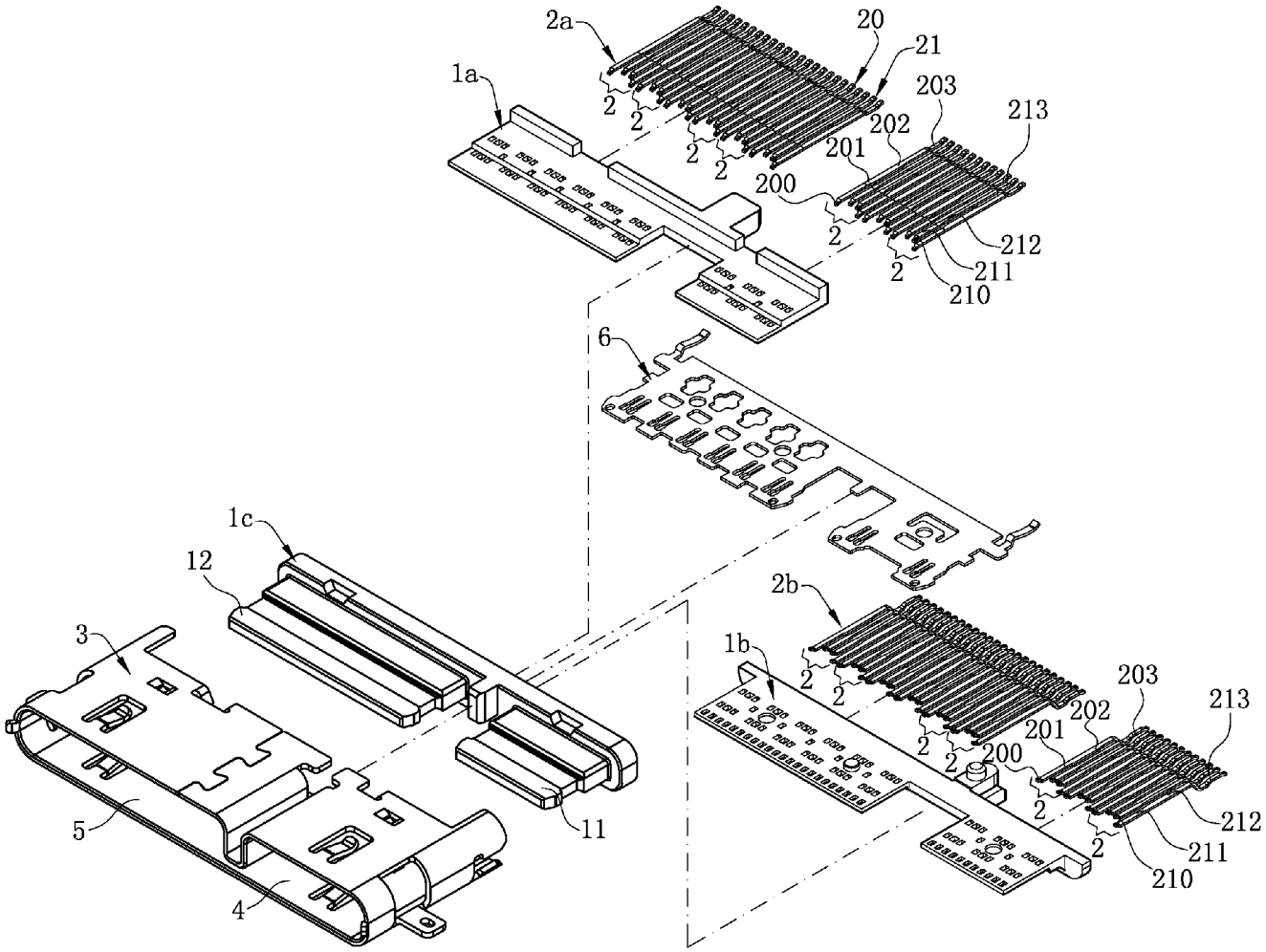
FIG. 1 is an exploded view of a composite connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-7. In accordance with the purposes of this invention, as embodied and broadly described herein, this invention, in one aspect, relates to a composite connector.

Figure 4:
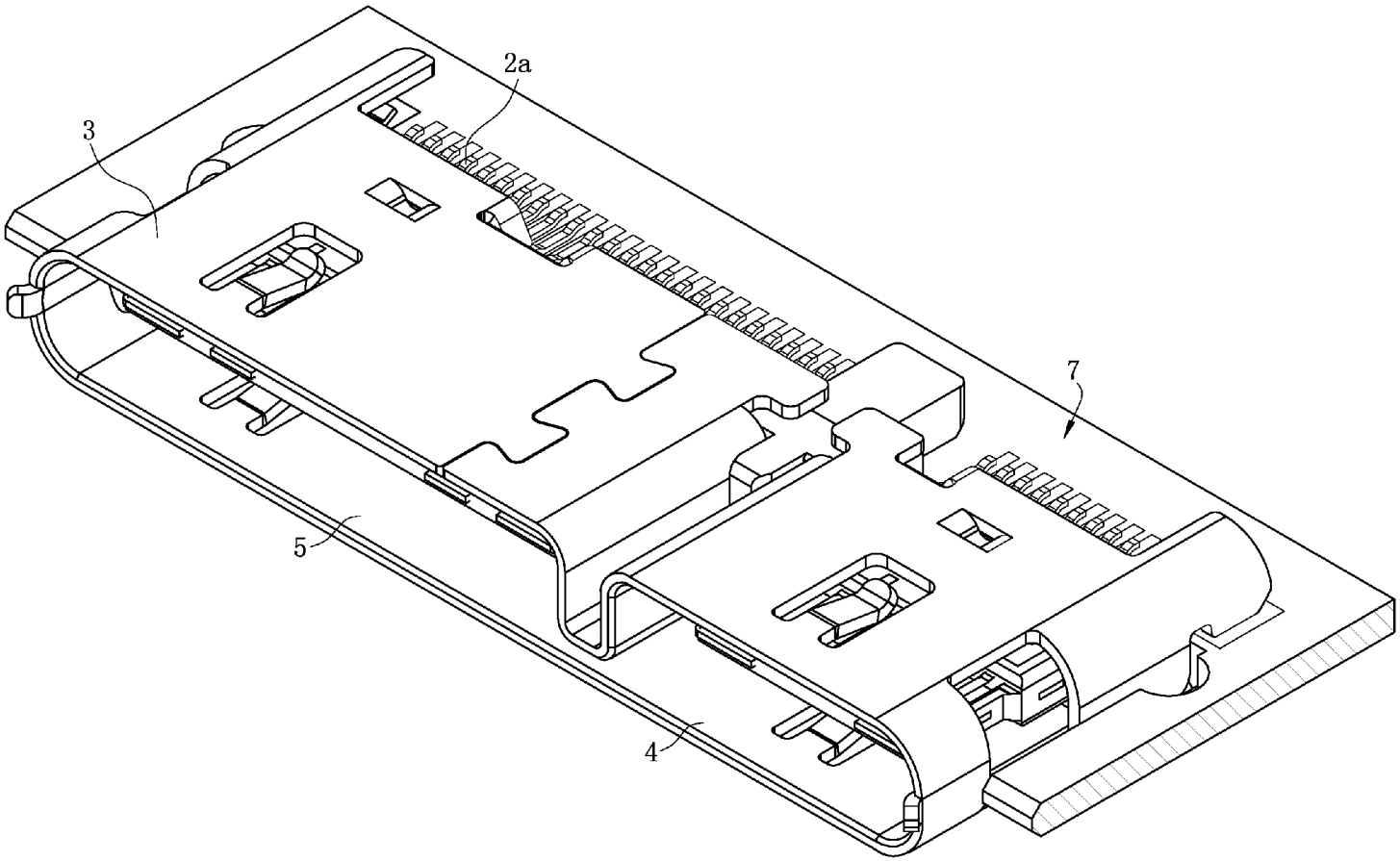
FIG. 4 is a three-dimensional diagram of soldering a composite connector according to one embodiment of the present invention to a circuit board in a clamping manner.

As shown in FIG. 1 and FIG. 4, a composite connector according to one embodiment of the present invention includes an insulation body 1, multiple terminal units 2 provided on the insulation body 1, and a metal shell 3 sleeved on a periphery of the insulation body 1. The metal shell 3 is sleeved on the insulation body 1 to form a first plug interface 4 and a second plug interface 5. The first plug interface 4 is used for insertion of a first mating connector (not shown), the second plug interface 5 is used for insertion of a second mating connector (not shown), and a combination of the first plug interface 4 and the second plug interface 5 is used for insertion of a third mating connector (not shown).

Figure 3:
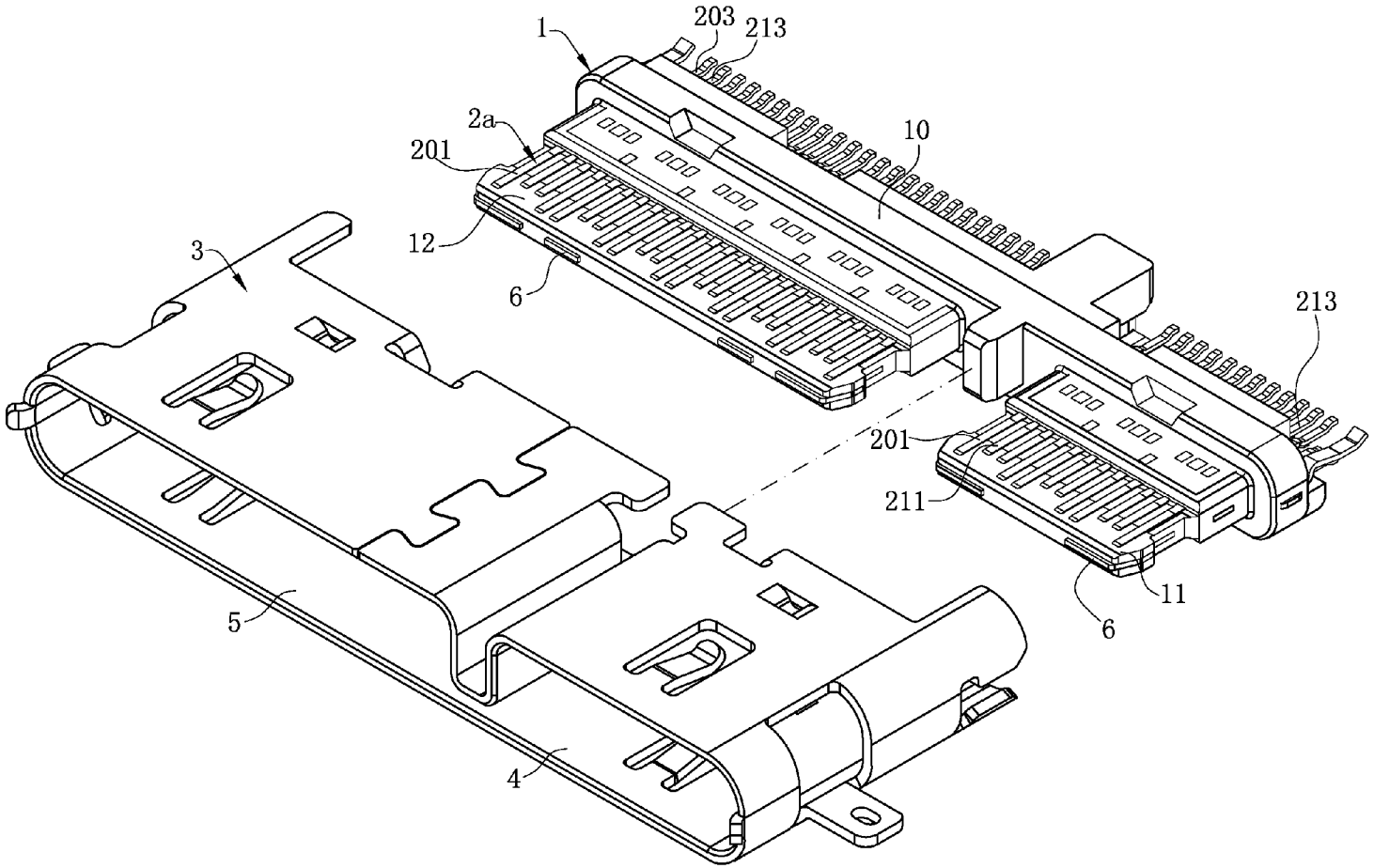
FIG. 3 is a schematic diagram of integral insert molding of an outer insulation body and the third module in FIG. 2.

In certain embodiments, the composite connector in this embodiment is a socket. As shown in FIG. 3, the insulation body 1 includes an elongated base 10, and a first tongue 11 and a second tongue 12 that extend forward from the base 10. The first tongue 11 and the second tongue 12 are located on a same plane. A width of the first tongue 11 is different from a width of the second tongue 12. There is a distance between the first tongue 11 and the second tongue 12, and the distance is a width for accommodating one or more of the terminal units 2. A middle shielding sheet 6 is respectively embedded in the first tongue 11 and the second tongue 12.

Figure 2:
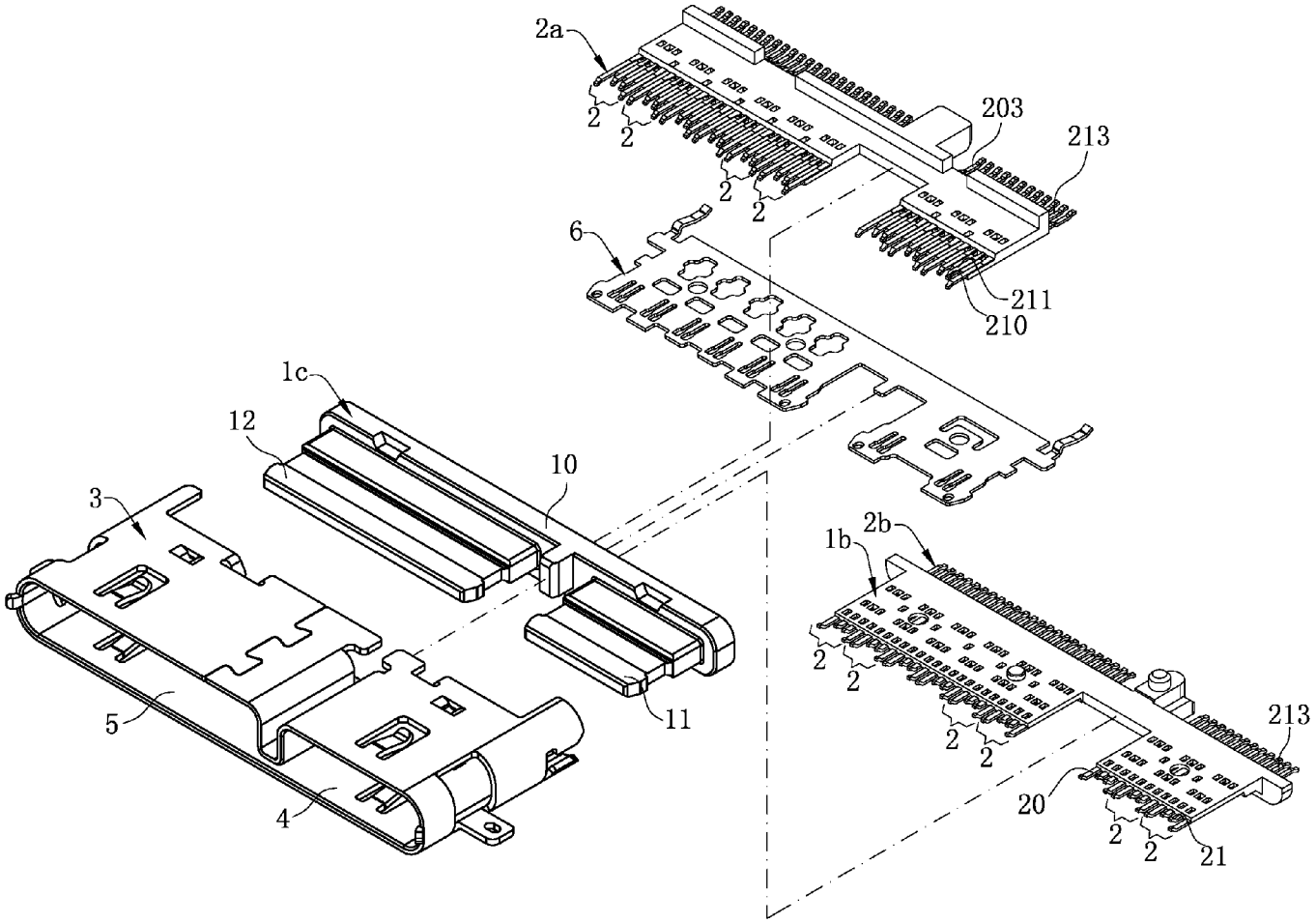
FIG. 2 is a schematic diagram of integral insert molding of terminals and upper and lower insulation bodies in FIG. 1.

More specifically, referring to FIG. 1 and FIG. 2, the insulation body 1 includes an upper insulation body 1*a*, a lower insulation body 1*b*, and an outer insulation body 1*c* that wraps the upper insulation body 1*a* and the lower insulation body 1*b*. An upper row of terminals 2*a* are insert-molded into the upper insulation body 1*a* to form a first module. A lower row of terminals 2*b* are insert-molded into the lower insulation body 1*b* to form a second module. The first module is assembled with the second module to clamp a middle shielding sheet 6 so as to form a third module. The outer insulation body 1*c* is over-molded with the third module.

As shown in FIG. 3, the first tongue 11 and the second tongue 12 respectively have an upper surface and a lower surface. The multiple terminal units 2 are provided on both the upper surface and the lower surface so as to form the upper row of terminals 2*a* and the lower row of terminals 2*b*. Each row of terminals is arranged centrosymmetrically. The upper and lower rows of terminals 2*a* and 2*b* are aligned with each other in an up-to-down direction, and the upper and lower rows of terminals 2*a* and 2*b* are symmetrically provided with the middle shielding sheet 6 as an axis of symmetry. The number of the terminal units 2 on the first tongue 11 is not equal to the number of the terminal units 2 on the second tongue 12. In certain embodiments, three of the terminal units 2 are respectively provided on the upper and lower surfaces of the first tongue 11, which are suitable for USB TYPE C signal transmission. However, six of the terminal units 2 are respectively provided on the upper and lower surfaces of the second tongue 12, which are suitable for extension of other signals.

Figure 5:
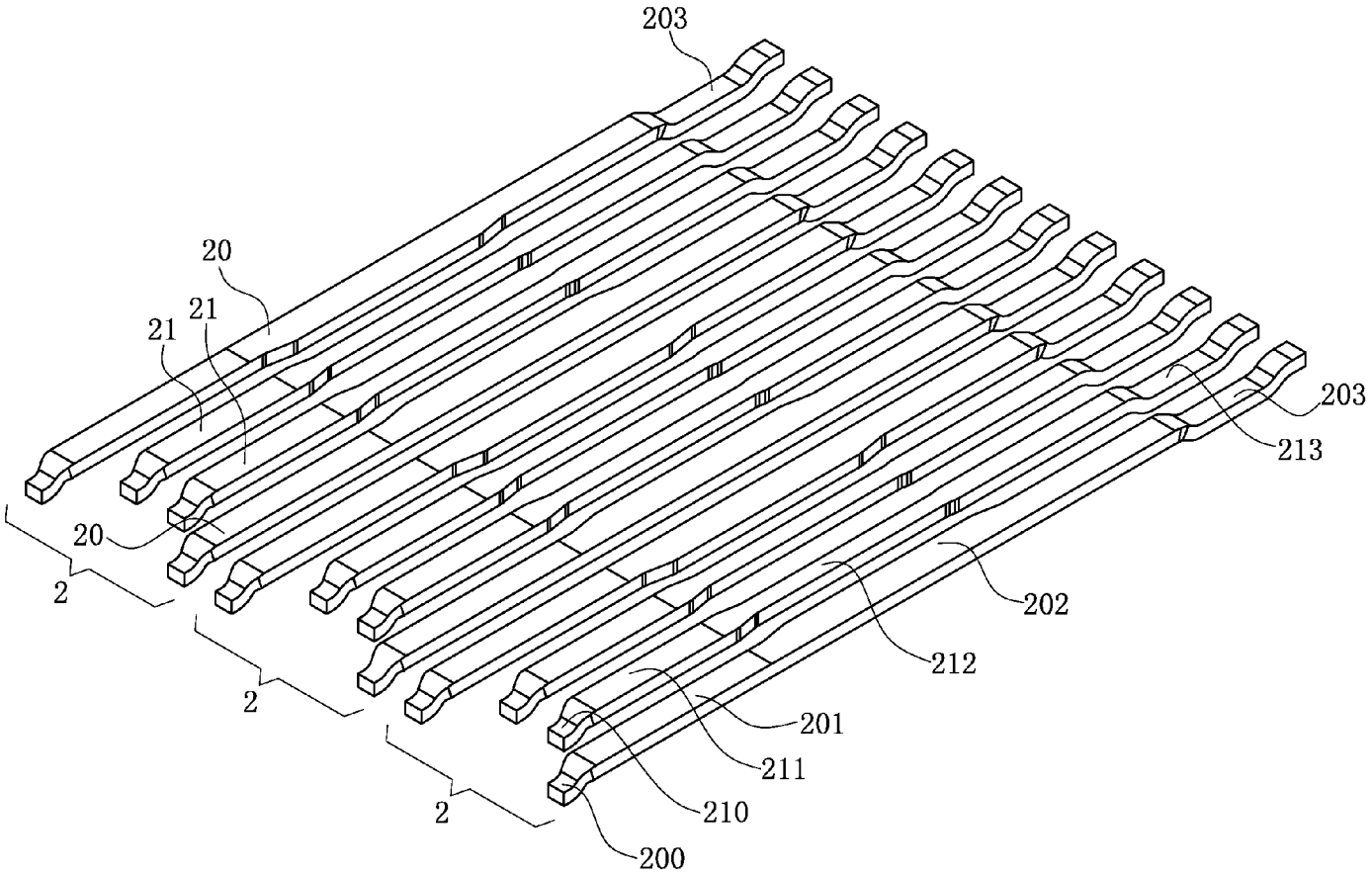
FIG. 5 is a schematic diagram of a terminal module on a first tongue according to one embodiment of the present invention.
Figure 6:
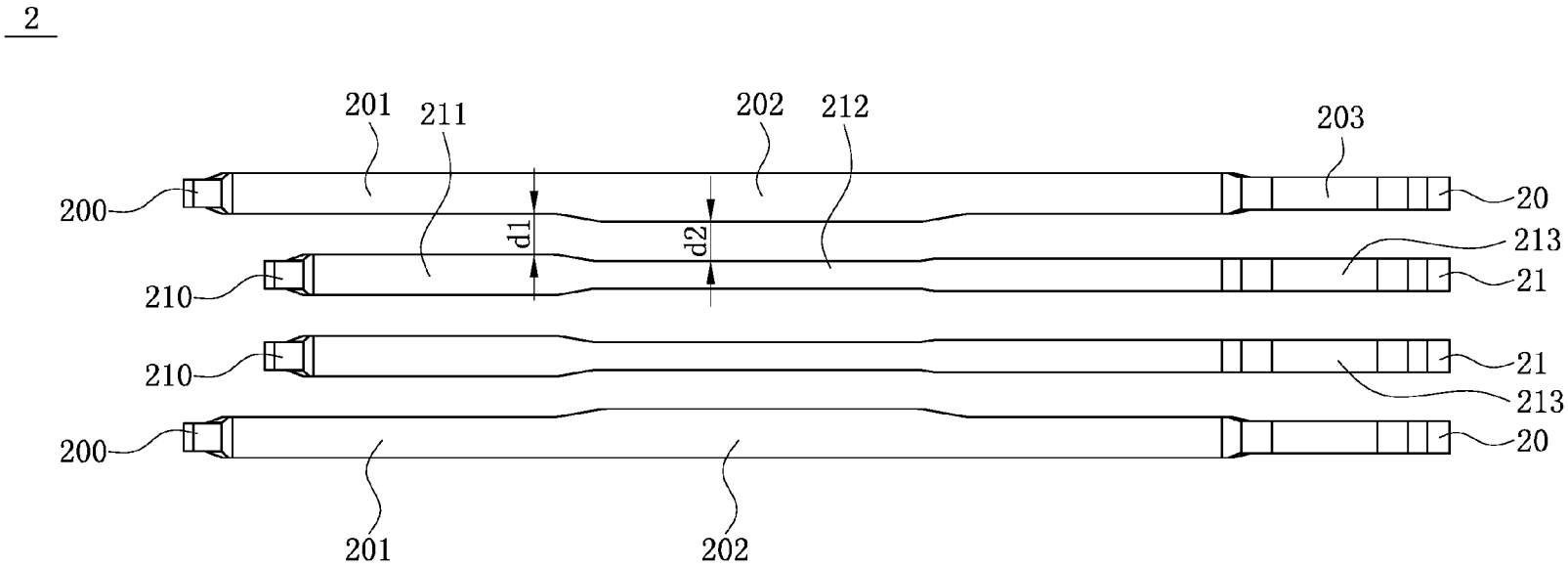
FIG. 6 is a top view of a terminal module according to one embodiment of the present invention.

In certain embodiments, as shown in FIG. 5 and FIG. 6, each of the terminal units 2 consists of four terminals independent from each other. The four terminals are made of a same metal plate and are located on a same plane. Specifically, the terminal unit 2 includes two non-high-speed differential signal terminals 20 and a pair of high speed differential signal terminals 21 located between the two non-high-speed differential signal terminals 20. Appearances of the non-high-speed differential signal terminals 20 are different from appearances of the high-speed differential signal terminals 21. More specifically, the multiple terminal units 2 located on the upper surfaces of the first tongue 11 and the second tongue 12 are made of a same metal plate and are located on a same plane. Similarly, the multiple terminal units 2 located on the lower surfaces of the first tongue 11 and the second tongue 12 are made of a same metal plate and are located on a same plane. The multiple terminal units 2 on the surfaces of the first tongue 11 and the second tongue 12 are sequentially arranged tightly close to each other. That is, there is no other terminal between adjacent two of the terminal units 2, and non-high-speed differential signal terminals 20 of one of the terminal units 2 are provided adjacent to non-high-speed differential signal terminals 20 of another one of the terminal units 2. In the connector according to certain embodiments of the present invention, each terminal is independent, and the terminals are not directly connected or indirectly connected through other elements. While on a circuit board 7, two terminals can be electrically connected through a printed circuit according to requirements.

Appearances and sizes of the two high-speed differential signal terminals 21 are the same. Each of the high-speed differential signal terminals 21 has a first head portion 210, a first contacting portion 211 that extends from the first head portion 210 backward and is exposed on upper or lower surfaces of the first tongue 11 or the second tongue 12, a first connecting portion 212 that extends from the first contacting portion 211 backward, and a first tail portion 213 that extends from the first connecting portion 212 backward. A width of the first connecting portion 212 is less than a width of the first contacting portion 211, and the first connecting portion 212 is attenuated for adjusting characteristic impedance.

Lengths of the non-high-speed differential signal terminals 20 are greater than lengths of the high-speed differential signal terminals 21, and the non-high-speed differential signal terminals 20 exceed the high-speed differential signal terminals 21 forward. Therefore, during mating, the non-high-speed differential signal terminals 20 first contact corresponding terminals in a mating connector. Appearances and sizes of the two non-high-speed differential signal terminals 20 are the same. Specifically, each of the non-high-speed differential signal terminals 20 has a second head portion 200, a second contacting portion 201 that extends from the second head portion 200 backward and is exposed on upper or lower surfaces of the first tongue 11 or the second tongue 12, a second connecting portion 202 that extends from the second contacting portion 201 backward, and a second tail portion 203 that extends from the second connecting portion 202 backward. The second tail portion 203 is flush to the first tail portion 213, and the second head portion 200 exceeds the first head portion 210 forward. The first tail portions 213 and the second tail portions 203 of the upper and lower rows of terminals 2*a* and 2*b* are also formed into two rows, and are soldered on upper and lower surfaces of the circuit board 7 in a clamping manner. To adjust characteristic impedance, a width of the second connecting portion 202 is greater than a width of the first connecting portion 212. Moreover, to enable distances between the high-speed differential signal terminals 21 and the non-high-speed differential signal terminals 20 to be consistent to a greatest extent for crosstalk improvement, a distance d1 between the first contacting portion 211 and the adjacent second contacting portion 201 is equal to a distance d2 between corresponding the first connecting portion 212 and the adjacent second connecting portion 202.

The non-high-speed differential signal terminals 20 are ground terminals, power terminals, or low speed signal terminals, for example, USB 2.0 signal terminals, or detection signal terminals. Because the high-speed differential signal terminals 21 can be compatible with non-high-speed differential signal transmission, the terminal arrangement manner according to certain embodiments of the present invention can satisfy a requirement for USB TYPE C signal transmission, and can also facilitate extensions of signals with other specifications.

Figure 7:
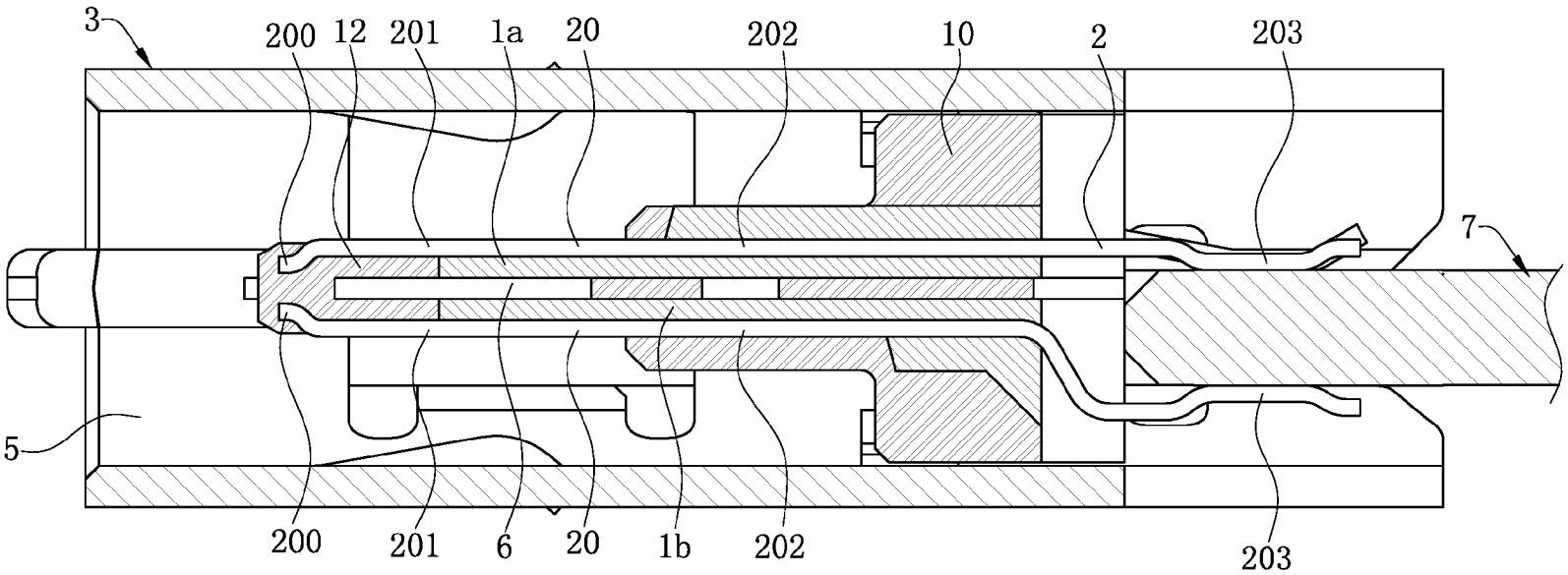
FIG. 7 is a sectional view in FIG. 4.

As shown in FIG. 4 and FIG. 7, the metal shell 3 is sleeved outside the base 10, and surrounds the first tongue 11 and the second tongue 12 to respectively form the first plug interface 4 and the second plug interface 5. The terminal arrangement on upper and lower surfaces of the first tongue 11 is suitable for USB TYPE C signal transmission, and therefore the first plug interface 4 is suitable for insertion of a standard USB TYPE C plug connector. The terminal arrangement on upper and lower surfaces of the second tongue 12 is suitable for extensions of other signals, and therefore the second plug interface 5 is suitable for insertion of DOCKING plug connectors of other types. A combination of the first plug interface 4 and the second plug interface 5 is suitable for integral insertion of the standard USB TYPE C connector and DOCKING connectors of other types.

In certain embodiments of the present invention, the terminal arrangement on the second tongue 12 is suitable for transmitting GSSGGSSG . . . signals; compared with the manner of transmitting GSSGSS . . . signals by using 3 terminals as a group, in this structure, a ground terminal G is added between adjacent two high-speed differential signal pairs (SS), and therefore a ground loop is added, so that crosstalk between the two high-speed differential signal pairs (SS) can be further improved, thereby improving a shielding effect.

In other embodiments, the composite connector may also be a plug connector, which includes the insulation body 1. Two mating portions are formed on a front end of the insulation body 1, a hollow mating cavity is formed on each of the mating portions, the terminal units 2 are separately provided on upper and lower sides of the mating cavity. Arrangement of the terminal units 2 on one of the mating portions is suitable for USB TYPE C signals, and the mating portion is suitable for insertion of a standard USB TYPE C receptacle, and terminal arrangement on the other mating portion is suitable for extending other signals, for example, peripheral component interconnect express (PCIE). The present invention is not limited thereto.

Compared with the related art, certain embodiments of the present invention have the following beneficial advantages.

1. A terminal unit 2 is formed of two non-high-speed differential signal terminals 20 and a pair of high-speed differential signal terminals 21 located between the two non-high-speed differential signal terminals 20. The terminal units 2 are sequentially arranged on an insulation body 1. Because the high-speed differential signal terminals 21 can be compatible with non-high-speed differential signal transmission, the manner of sequentially arranging multiple terminal units 2 not only can satisfy a requirement for USB TYPE C signal transmission, but also can implement extensions of signals with other specifications. Moreover, a punching mold for shaping terminals can be simplified in the manner of regularly arranging, in an electrical connector, units with each being formed by four terminals, so as to reduce mold costs, so that fabrication and production of molds become easier and a requirement for a large number of terminals can be satisfied.

2. The multiple terminals units 2 on upper and lower surfaces of the first tongue 11 and the second tongue 12 are separately made of a same metal plate and are separately located on a same plane, so as to simplify a punching mold for shaping terminals, and reduce mold costs, so that fabrication and production of molds become easier, and the present invention can also satisfy a requirement for a large number of terminals.

3. A width of a first connecting portion 212 is less than a width of a first contacting portion 211 of the high-speed differential signal terminal 21, and the first connecting portion 212 is attenuated for adjusting characteristic impedance.

4. A width of the second connecting portion 202 is greater than a width of the first connecting portion 212. Moreover, a distance between a first contacting portion 211 and an adjacent second contacting portion 201 is equal to a distance between corresponding a first connecting portion 212 and an adjacent second connecting portion 202, and distances between the high-speed differential signal terminals 21 and the non-high-speed differential signal terminals 20 may be enabled to be consistent to a greatest extent for crosstalk improvement, and for adjusting characteristic impedance at the same time.

5. Lengths of the non-high-speed differential signal terminals 20 are greater than lengths of the high-speed differential signal terminals 21, so that crosstalk between different high-speed differential signal pairs can be shielded to improve high frequency.

6. There is a distance between the first tongue 11 and the second tongue 12, where the distance is a width occupied by one or more terminal unit 2, and this design facilities fabrication molding.

7. The metal shell 3 separately surrounds the first tongue 11 and the second tongue 12 to form a first plug interface 4 and a second plug interface 5. The first plug interface 4 is used for insertion of a first mating connector; the second plug interface 5 is used for insertion of a second mating connector, and a combination of the first plug interface 4 and the second plug interface 5 is used for insertion of a third mating connector. The structure can implement extensions of different specifications to be compatible with different mating connectors.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A composite connector, comprising:

an insulation body;

a plurality of terminal units, arranged on the insulation body, wherein each of the terminal units comprises four terminals independent from each other, which are respectively two non-high-speed differential signal terminals and a pair of high-speed differential signal terminals located between the two non-high-speed differential signal terminals, wherein for each of the terminal units, the two non-high-speed differential signal terminals and the pair of high-speed differential signal terminals are aligned in a row, lengths of the non-high-speed differential signal terminals are greater than lengths of the high-speed differential signal terminals, there is no other terminal between adjacent two terminal units, and a non-high-speed differential signal terminal of one of the adjacent two terminal units is adjacent to a corresponding non-high-speed differential signal terminal of the other one of the adjacent two terminal units, and a metal shell sleeved on the insulation body to form a first plug interface and a second plug interface, wherein the first plug interface is used for insertion of a first mating connector, the second plug interface is used for insertion of a second mating connector, and a combination of the first plug interface and the second plug interface is used for insertion of a third mating connector;

wherein each of the high-speed differential signal terminals has a first contacting portion and a first connecting portion that extends from the first contacting portion, the first contacting portion is exposed on a surface of the insulation body, and a width of the first connecting portion is less than a width of the first contacting portion;

wherein the non-high-speed differential signal terminal has a second contacting portion and a second connecting portion that extends from the second contacting portion, the second contacting portion is exposed on a surface of the insulation body, a width of the second connecting portion greater than a width of the first connecting portion; and wherein a distance between the first contacting portion and the adjacent second contacting portion is equal to a distance between the first connecting portion and the adjacent second connecting portion.

2. The composite connector of claim 1, wherein the terminal units respectively form an upper row of terminals and a lower row of terminals, and the upper row of terminals and the lower row of terminals are aligned with each other in an up-to-down direction.

3. The composite connector of claim 2, wherein the upper row of terminals and the lower row of terminals are respectively made by a same metal plate, and are respectively located on a same plane.

4. The composite connector of claim 1, wherein the non-high-speed differential signal terminals are ground terminals, power terminals, or low speed signal terminals.

5. The composite connector of claim 1, wherein the high-speed differential signal terminal has a first head portion located in front of the first contacting portion, and a first tail portion located behind the first connecting portion, the non-high-speed differential signal terminal has a second head portion located in front of the second contacting portion, and a second tail portion located behind the second connecting portion, the second tail portion is flush to the first tail portion, and the second head portion exceeds the first head portion forward.

6. A composite connector, comprising:

a first tongue and a second tongue; and a plurality of terminal units, respectively arranged on the first tongue and the second tongue, wherein each of the terminal units comprises four terminals independent from each other, which are respectively two non-high-speed differential signal terminals and a pair of high-speed differential signal terminals located between the two non-high-speed differential signal terminals, and for each of the terminal units, the two non-high-speed differential signal terminals and the pair of high-speed differential signal terminals are aligned in a row;

wherein terminals in each of the terminal units are made of a same metal plate and are located on a same plane;

wherein there is no other terminal between adjacent two terminal units, and a non-high-speed differential signal terminal of one of the adjacent two terminal units is adjacent to corresponding one non-high-speed differential signal terminal of the other one of the adjacent two terminal units; and wherein a width of the first tongue is different from a width of the second tongue, there is a distance between the first tongue and the second tongue, and the distance is a width needed by one or more terminal units;

wherein each of the high-speed differential signal terminals has a first contacting portion and a first connecting portion that extends from the first contacting portion, the first contacting portion is exposed on a surface of the first tongue or the second tongue, and a width of the first connecting portion is less than a width of the first contacting portion;

wherein each of the non-high-speed differential signal terminal has a second contacting portion and a second connecting portion that extends from the second contacting portion, the second contacting portion is exposed on a surface of the first tongue or the second tongue, a width of the second connecting portion is greater than a width of the first connecting portion; and wherein a distance between the first contacting portion and the adjacent second contacting portion is equal to a distance between corresponding the first connecting portion and the adjacent second connecting portion.

7. The composite connector of claim 6, wherein the non-high-speed differential signal terminals are ground terminals, power terminals, or low speed signal terminals.

8. The composite connector of claim 6, wherein lengths of the non-high-speed differential signal terminals are greater than lengths of the high-speed differential signal terminals.

9. The composite connector of claim 6, wherein the terminal units are provided on both upper and lower surfaces of the first tongue and the second tongue to respectively form an upper row of terminals and a lower row of terminals, and the number of the terminal units on the first tongue is not equal to the number of the terminal units on the second tongue.

10. The composite connector of claim 9, wherein the terminal units located on the upper surfaces of the first tongue or the second tongue are made of a same metal plate and are located on a same plane, and the terminal units located on the lower surfaces of the first tongue or the second tongue are made of a same metal plate and are located on a same plane.

11. The composite connector of claim 9, wherein a middle shielding sheet is separately embedded in the first tongue and the second tongue, the middle shielding sheet is located between the upper row of terminals and the lower row of terminals, and the upper row of terminals and the lower row of terminals are symmetrically disposed with the middle shielding sheet as an axis of symmetry.

12. The composite connector of claim 6, wherein the first tongue and the second tongue are separately formed by extending from a same base, and the first tongue and the second tongue are located on a same plane.

13. The composite connector of claim 6, wherein three of the terminal units are respectively provided on upper and lower surfaces of the first tongue, and terminal arrangement on the first tongue is suitable for USB TYPE C signal transmission.

14. The composite connector of claim 6, further comprising a metal shell separately surrounds the first tongue and the second tongue to respectively form a first plug interface and a second plug interface, wherein the first plug interface is used for insertion of a first mating connector, the second plug interface is used for insertion of a second mating connector, and a combination of the first plug interface and the second plug interface is used for insertion of a third mating connector.

* * * * *